US006679468B1

(12) United States Patent
Hsu

(10) Patent No.: US 6,679,468 B1
(45) Date of Patent: Jan. 20, 2004

(54) PEN BOX STRUCTURE HAVING THE FUNCTION OF A BOOK SUPPORT SHELF

(75) Inventor: Rong-Li Hsu, Jen-De Hsien (TW)

(73) Assignee: Kuo-Liang Hsu, Tainan Shien (TW)

( * ) Notice: Subject to any disclaimer, the term of this patent is extended or adjusted under 35 U.S.C. 154(b) by 90 days.

(21) Appl. No.: 09/799,031

(22) Filed: Mar. 6, 2001

(51) Int. Cl.[7] ..... A47G 1/24

(52) U.S. Cl. ..... 248/454; 248/456; 248/461; 312/233

(58) Field of Search ..... 248/447, 454, 248/455, 457, 460, 461, 462, 453, 452, 448; 312/233, 231; 211/69.1, 69.3, 43

(56) References Cited

U.S. PATENT DOCUMENTS

| | | | | | |
|---|---|---|---|---|---|
| 352,654 | A | * | 11/1886 | Morton | 248/452 |
| 543,812 | A | * | 7/1895 | Platt | 312/231 |
| 1,839,291 | A | * | 1/1932 | Barbour | 312/233 |
| 2,014,176 | A | * | 9/1935 | Henderson | 248/456 |
| 2,419,721 | A | * | 4/1947 | Kopp | 248/456 |
| 2,489,553 | A | * | 11/1949 | Wofford | 248/449 |
| 4,436,271 | A | * | 3/1984 | Manso | 248/460 |
| 4,978,096 | A | * | 12/1990 | Struckmann | 248/451 |
| 5,409,383 | A | * | 4/1995 | Mannino | 434/414 |
| 5,690,216 | A | * | 11/1997 | Liu | 206/214 |
| 6,045,108 | A | * | 4/2000 | Cziraky | 248/454 |
| 6,199,816 | B1 | * | 3/2001 | Case | 248/460 |

FOREIGN PATENT DOCUMENTS

JP 2000-163046 * 6/2000

* cited by examiner

*Primary Examiner*—Leslie A. Braun
*Assistant Examiner*—Gwendolyn Baxter
(74) *Attorney, Agent, or Firm*—Rosenberg, Klein & Lee

(57) ABSTRACT

A pen box structure includes a box body pivoted with a box cover. The box body has one side defining an opening and has two inner walls each provided with a guide track which is provided with a lug that defines an insertion groove. The box cover has an inner face provided with a locking flange, and a lock mating device is locked on the locking flange, so that the box cover forms a proper included angle relative to the box body. A retractable drawer is movably inserted in the opening, and has two ends each provided with an insertion rod movably inserted in the guide track. The insertion rod has one side provided with a plate movably inserted in the insertion groove, and two L-shaped book clamping blocks pivotally mounted in the drawer.

5 Claims, 8 Drawing Sheets

PEN BOX STRUCTURE HAVING THE FUNCTION OF A BOOK SUPPORT SHELF

BACKGROUND OF THE INVENTION

1. Field of the Invention

The present invention relates to a pen box structure having the function of a book support shelf.

2. Description of the Related Prior Art

A conventional pen box structure having the function of a book support shelf in accordance with the prior art shown in FIG. 8 comprises a box cover 41 pivoted with a box body 40 and having an inner face pivoted with two book clip blocks 42 and an outer face provided with two support pieces 43.

However, the conventional pen box structure has the following disadvantages.

1. The included angle between the box body 40 and the box cover 41 is an obtuse angle, while the support pieces are pivoted with the box cover 41, thereby forming an unstable book support structure.
2. The entire book support structure is not rigid and stable, so that the stationery contained in the pen box structure easily falls out, thereby causing inconvenience in use.
3. The user cannot adjust the inclined angle of the book arbitrarily, thereby causing inconvenience in use.

SUMMARY OF THE INVENTION

The present invention has arisen to mitigate and/or obviate the disadvantage of the conventional pen box structure having the function of a book support shelf.

In accordance with the present invention, there is provided a pen box structure having the function of a book support shelf comprising: a box body pivoted with a box cover, the box body having one side defining an opening, the box body having two inner walls each provided with a guide track connecting to the opening, the guide track provided with a lug, the lug being higher than a bottom face of the box body to form an insertion groove, the box cover having an inner face provided with at least one locking flange, a lock mating device mounted on the box body, the lock mating device matingly locked on the at least one locking flange of the box cover, so that the box cover forms a proper included angle relative to the box body, a retractable drawer movably inserted in the opening of the box body, the retractable drawer having two ends each provided with an insertion rod movably inserted in the guide track of the box body, the insertion rod having one side provided with a plate movably inserted in the insertion groove, and two substantially L-shaped book clamping blocks pivotally mounted in the retractable drawer.

Further benefits and advantages of the present invention will become apparent after a careful reading of the detailed description with appropriate reference to the accompanying drawings.

DETAILED DESCRIPTION OF THE INVENTION

Figure 1:
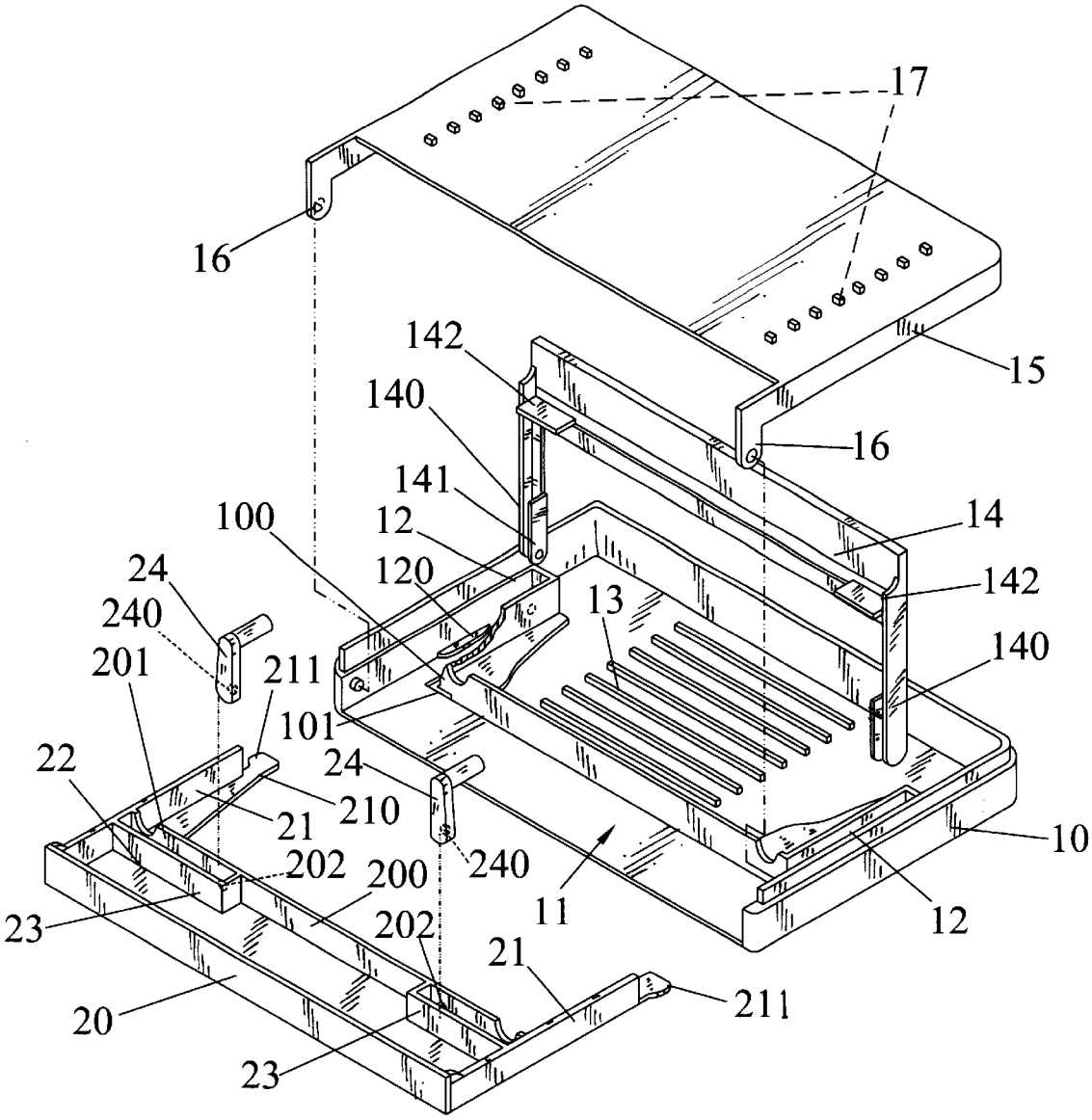
FIG. 1 is an exploded perspective view of a pen box structure having the function of a book support shelf in accordance with the present invention.
Figure 2:
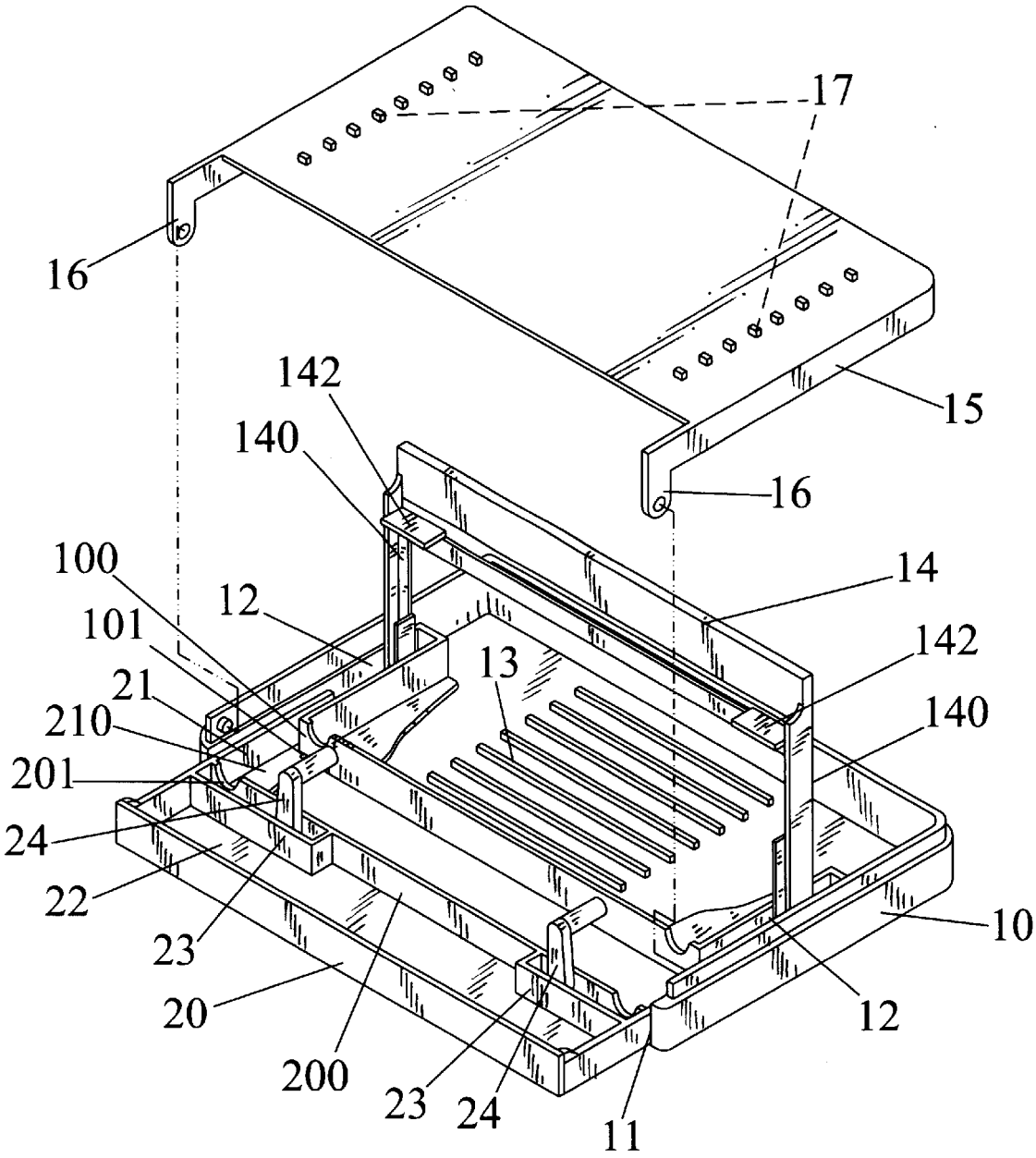
FIG. 2 is partially assembly view of the pen box structure having the function of a book support shelf as shown in FIG. 1.
Figure 3:
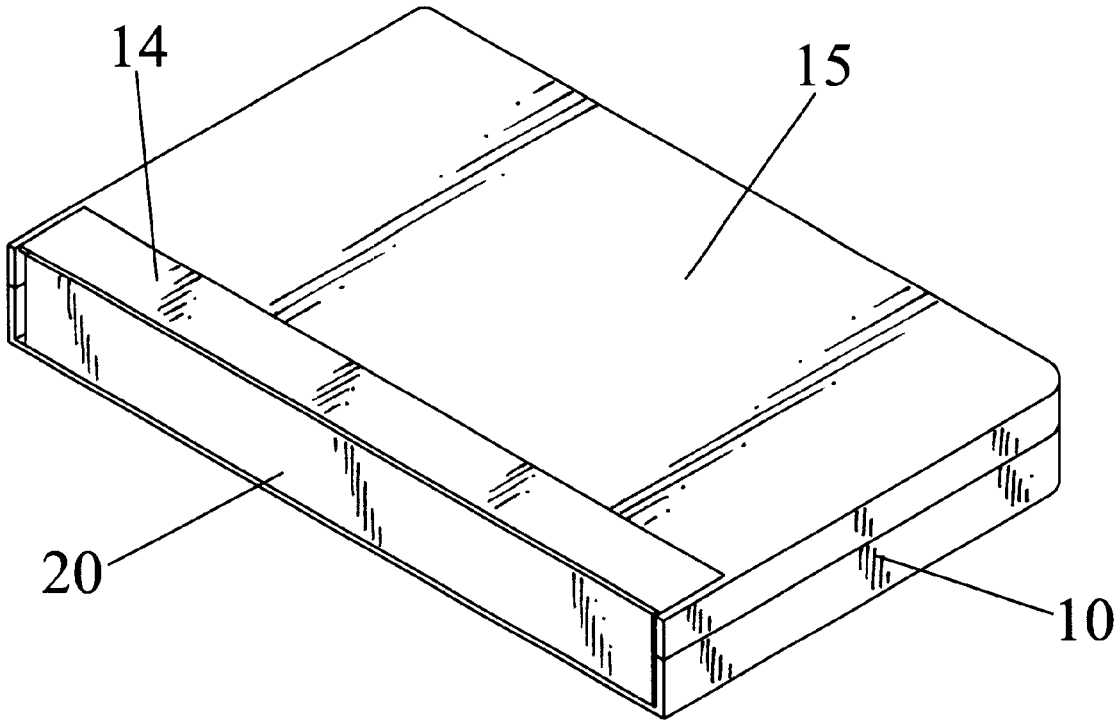
FIG. 3 is a perspective assembly view of the pen box structure having the function of a book support shelf as shown in FIG. 1.

Referring to the drawings and initially to FIGS. 1–3, a pen box structure having the function of a book support shelf in accordance with the present invention comprises a box body 10 pivoted with a box cover 15.

The box body 10 has one side defining an opening 11. The box body 10 has two inner walls each provided with a guide track 12 connecting to the opening 11. The guide track 12 is provided with a lug 100. The lug 100 is higher than the bottom face of the box body 10 to form an insertion groove 101. The box cover 15 has an inner face provided with at least one locking flange 17. Preferably, the box cover 15 includes a plurality of locking flanges 17 which are parallel arranged with each other.

A retractable drawer 20 is movably inserted in the opening 11 of the box body 10. The retractable drawer 20 has two ends each provided with an insertion rod 21 movably inserted in the guide track 12 of the box body 10. The insertion rod 21 has one side provided with a plate 210 movably inserted in the insertion groove 101. The retractable drawer 20 has a side wall 200 provided with two pivot portions 23. Two substantially L-shaped book clamping blocks 24 are each pivotally mounted in the pivot portion 23 of the retractable drawer 20. Each of the two book clamping blocks 24 is provided with a pivot axle 240 pivotally mounted in a pivot hole 202 defined in the side wall 200 of the drawer 20.

A lock mating device is mounted on the box body 10. The lock mating device is matingly locked on the locking flange 17 of the box cover 15, so that the box cover 15 forms a proper included angle relative to the box body 10.

The lock mating device includes a substantially inverted U-shaped support bracket 14 pivotally mounted in the box body 10. The support bracket 14 has two leg posts 140 each pivotally mounted in the two opposite inner walls of the box body 10 by a pivot axle 141, so that the support bracket 14 forms a proper included angle relative to the box body 10, and the support bracket 14 has a top edge locked on the locking flange 17 of the box cover 15, thereby efficiently supporting the box cover 15, whereby a book 30 may be placed on the back face of the box cover 15 as shown in FIG. 4.

Figure 4:
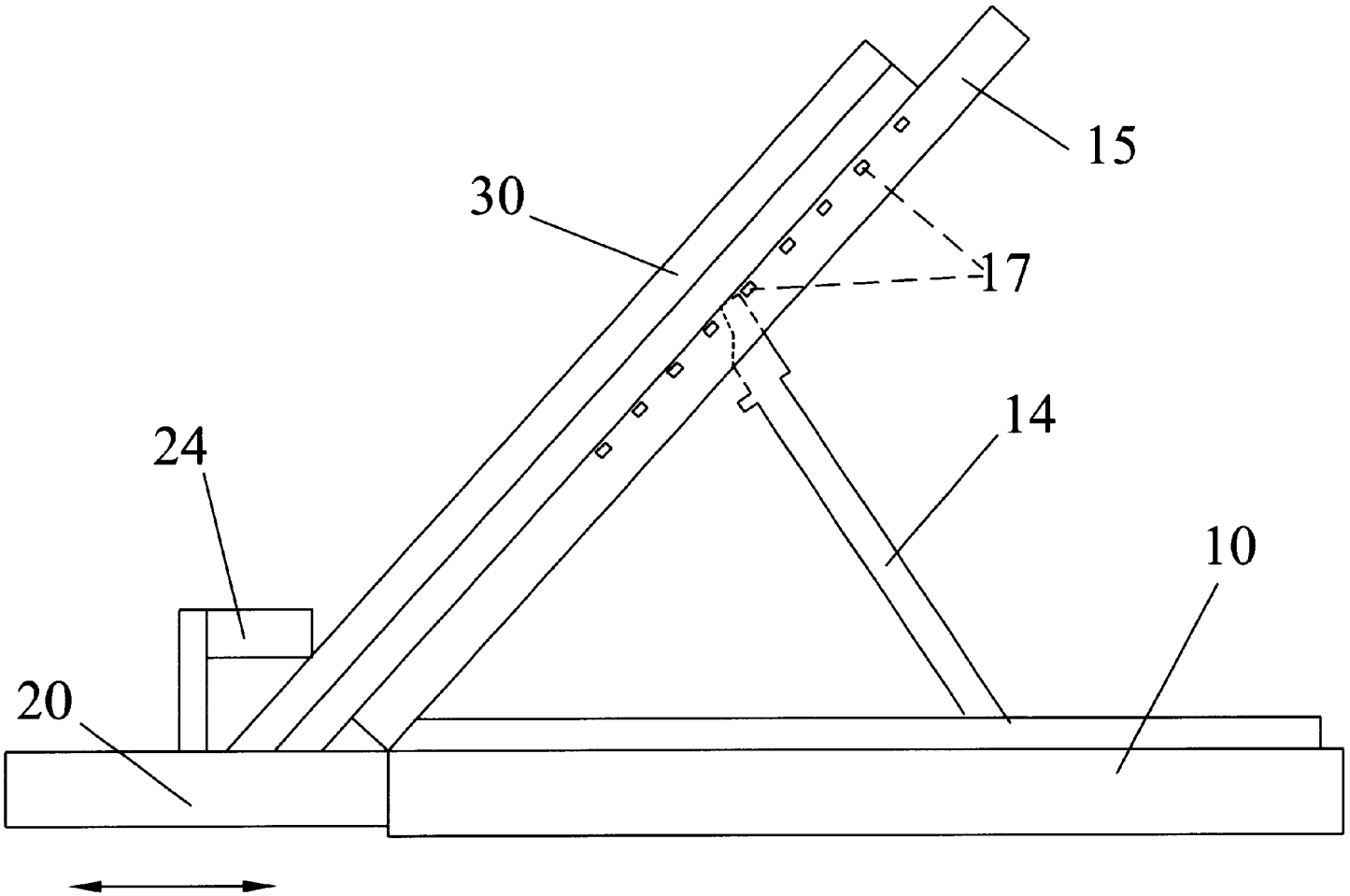
FIG. 4 is a side plan assembly view of the pen box structure having the function of a book support shelf as shown in FIG. 1.

As shown in FIGS. 4–7, the box cover 15 may have various inclined angles, whereby the book 30 may have various inclined angles, so that the present invention has a multi-angle book reading function. Again referring to FIG. 4, the drawer 20 is movable to expand or retract in the directions as indicated by arrows so as to slightly adjust the inclined angle of the book 30. In such a manner, the inclined angle of the book 30 can be adjusted in a large scale by the support bracket 14 as shown in FIGS. 4–7, and can be slightly adjusted by the drawer 20 as shown in FIG. 4, thereby achieving the adjusting function of a full angle.

Again referring to FIG. 1, the guide track 12 of the box body 10 is provided with protruding flange 120 which is gradually lifted toward the opening 11 of the box body 10, and the plate 210 of the insertion rod 21 has a distal end provided with an outward protruding locking edge 211, so that when the drawer 20 is drawn outward relative to the box body 10 to a proper position, the locking edge 211 is urged by the protruding flange 120, thereby securing the drawer 20 relative to the box body 10 so as to clamp the book efficiently.

In addition, the support bracket 14 is provided with two locking flanges 142 which are hooked on the inner edge of the side wall 200 of the drawer 20 when the support bracket 14 is pivoted to cover the drawer 20, thereby preventing the drawer 20 from detaching arbitrarily.

Further, the side wall 200 of the drawer 20 defines two recesses 201 each provided for receiving each of the two book clamping blocks 24 when each of the two book clamping blocks 24 is folded downward, so that the drawer 20 may be retracted into the box body 10 in a normal manner.

Accordingly, the pen box structure in accordance with the present invention has the following advantages.

Figure 5:
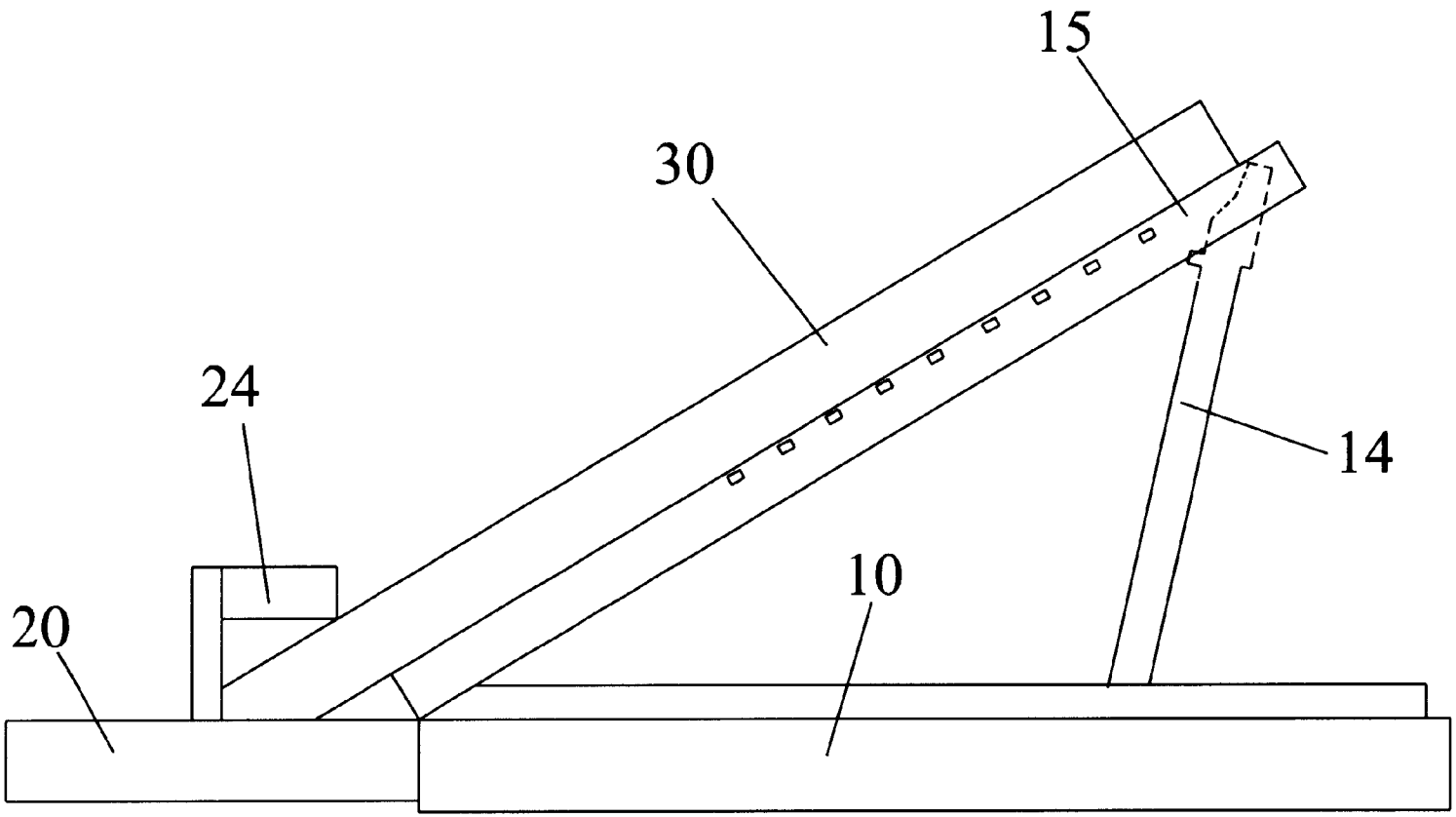
FIG. 5 is a schematic operational view of the pen box structure having the function of a book support shelf as shown in FIG. 4.
Figure 6:
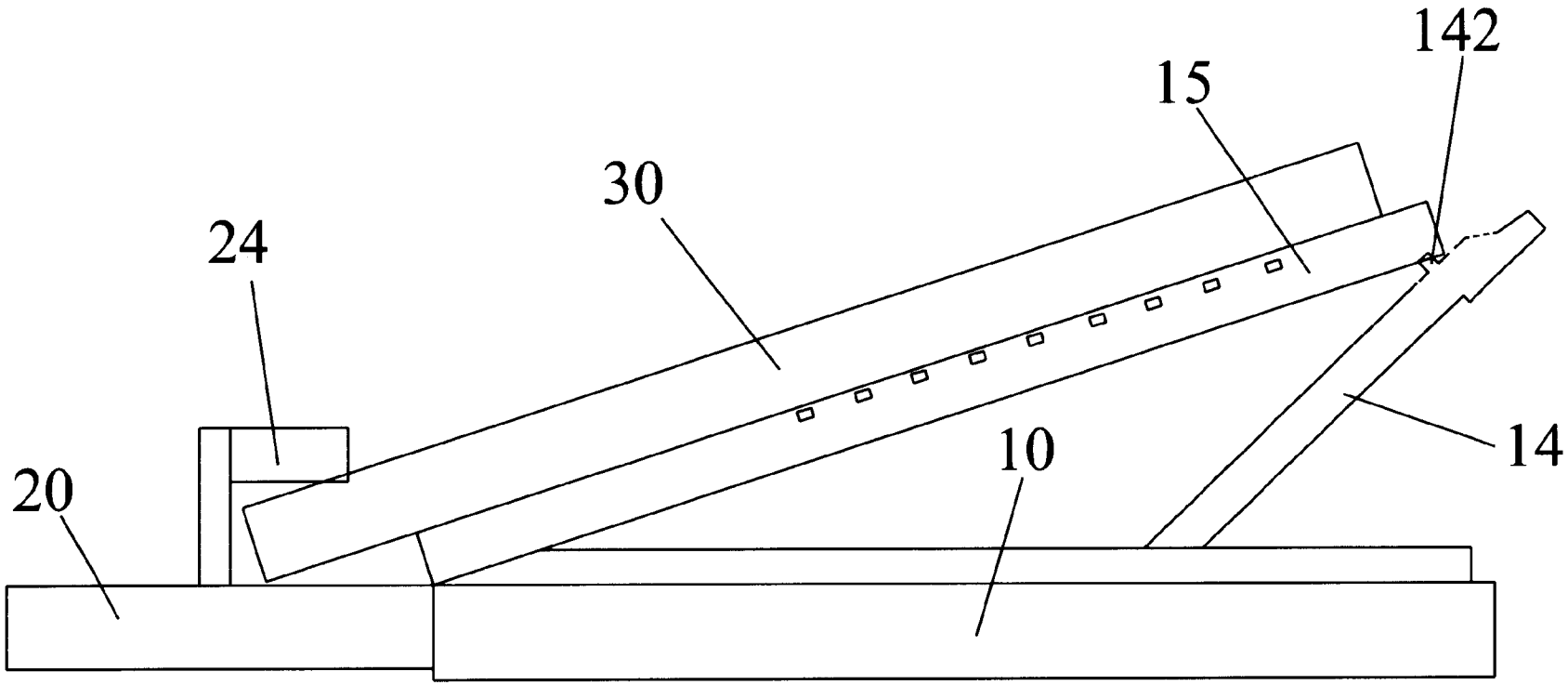
FIG. 6 is a further operational view of the pen box structure having the function of a book support shelf as shown in FIG. 4.
Figure 7:
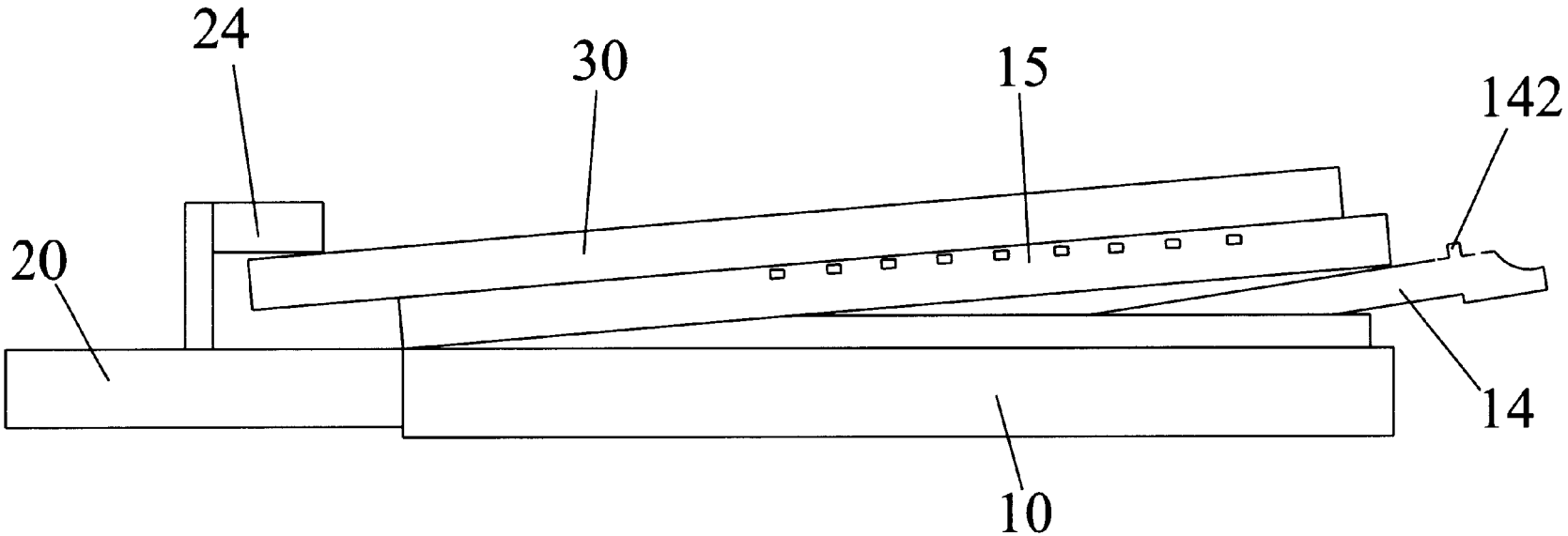
FIG. 7 is a further operational view of the pen box structure having the function of a book support shelf as shown in FIG. 4.
Figure 8:
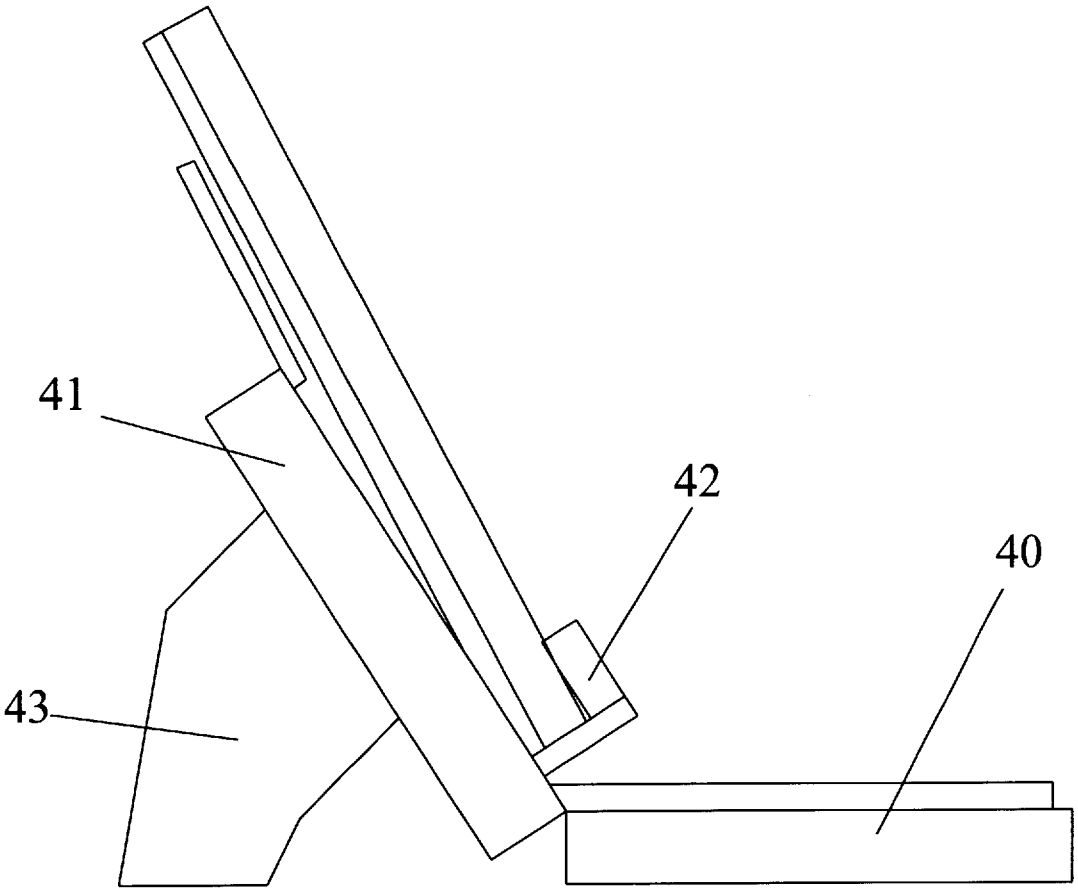
FIG. 8 PRIOR ART
FIG. 8 a side plan view of a conventional pen box structure having the function of a book support shelf in accordance with the prior art.

1. The included angle between the box body and the box cover is an acute angle, thereby forming a rigid and stable support structure.
2. The user can arbitrarily adjust the inclined angle of the book as shown in FIGS. 4 and 5, thereby facilitating the user reading the book.
3. The book can be clamped by the book clamping blocks, while the drawer can be drawn outward simultaneously, thereby facilitating the user taking the stationery.

Although the invention has been explained in relation to its preferred embodiment as mentioned above, it is to be understood that many other possible modifications and variations can be made without departing from the scope of the present invention. It is, therefore, contemplated that the appended claims will cover such modifications and variations that fall within the true scope of the invention.

What is claimed is:

1. A pen box structure having a function of a book support shelf comprising: a box body (10) pivoted with a box cover (15), said box body (10) having one side defining an opening (11), said box body (10) having two inner walls, each wall provided with a guide track (12) connecting to said opening (11), said guide track (12) provided with a lug (100), said lug (100) being higher than a bottom face of said box body (10) to form an insertion groove (101), said box cover (15) having an inner face provided with at least one locking flange (17), a lock mating device mounted on said box body (10), said lock mating device includes a substantially inverted U-shaped support bracket (14) pivotally mounted in said box body (10), said support bracket (14) having two leg posts (140), each post pivotally mounted on two opposite inner walls of said box body (10) by a pivot axle (141), so that said support bracket (14) forms a proper inclined angle relative to said box body (10), and said box cover (15) forms a proper inclined angle relative to said box body (10), a retractable drawer (20) movably inserted in said opening (11) of said box body (10), said retractable drawer (20) having two ends, each end provided with an insertion rod (21) movably inserted in said guide track (12) of said box body (10), said insertion rod (21) having one side provided with a plate (210) movably inserted in said insertion groove (101), and two substantially L-shaped book clamping blocks (24) pivotally mounted in said retractable drawer (20).

2. The pen box structure having the function of the book support shelf in accordance with claim 1, wherein said box cover (15) includes a plurality of locking flanges (17) which are parallel arranged with each other.

3. The pen box structure having the function of the book support shelf in accordance with claim 1, wherein said guide track (12) of said box body (10) is provided with protruding flange (120) which is gradually lifted toward said opening (11) of said box body (10), and said plate (210) of said insertion rod (21) has a distal end provided with an outward protruding locking edge (211), so that when said drawer (20) is drawn outward relative to said box body (10) to a proper position, said locking edge (211) is urged by said protruding flange (120), thereby securing said drawer (20) relative to said box body (10).

4. The pen box structure having the function of the book support shelf in accordance with claim 1, wherein said support bracket (14) is provided with two locking flanges (142) which are hooked on an inner edge of a side wall (200) of said drawer (20) when said support bracket (14) is pivoted to cover said drawer (20).

5. The pen box structure having the function of the book support shelf in accordance with claim 4, wherein said side wall (200) of said drawer (20) defines two recesses (201) each recess provided for receiving each of said two book clamping blocks (24) when each of said two book clamping blocks (24) is folded downward, so that said drawer (20) may be retracted into said box body (10).

* * * * *